US009208628B2

(12) United States Patent
Gokcebay

(10) Patent No.: US 9,208,628 B2
(45) Date of Patent: Dec. 8, 2015

(54) ELECTRONIC LOCKS PARTICULARLY FOR OFFICE FURNITURE

(71) Applicant: Security People, Inc., Petaluma, CA (US)

(72) Inventor: Asil T. Gokcebay, Petaluma, CA (US)

(73) Assignee: Security People, Inc., Petaluma, CA (US)

( * ) Notice: Subject to any disclaimer, the term of this patent is extended or adjusted under 35 U.S.C. 154(b) by 119 days.

(21) Appl. No.: 13/945,695

(22) Filed: Jul. 18, 2013

(65) Prior Publication Data

US 2014/0318198 A1 Oct. 30, 2014

Related U.S. Application Data

(63) Continuation-in-part of application No. 11/809,172, filed on May 30, 2007, now Pat. No. 8,495,898, and a continuation-in-part of application No. 12/214,357, filed on Jun. 17, 2008, now Pat. No. 8,490,443.

(51) Int. Cl.

| | |
|---|---|
| ***E05B 65/46*** | (2006.01) |
| ***E05B 47/06*** | (2006.01) |
| ***G07C 9/00*** | (2006.01) |

(Continued)

(52) U.S. Cl.

CPC ..... *G07C 9/00666* (2013.01); *E05B 47/06* (2013.01); *E05B 65/46* (2013.01); *E05B 65/462* (2013.01); *E05C 1/04* (2013.01); *E05C 3/042* (2013.01); *E05B 65/025* (2013.01); *E05B 2047/0094* (2013.01); *G07C 2209/04* (2013.01); *Y10T 70/7068* (2015.04); *Y10T 70/713* (2015.04)

(58) Field of Classification Search

CPC ..... E05B 65/44; E05B 65/46; E05B 65/461; E05B 65/462; E05B 63/0052; E05B 65/02; E05B 65/025; E05B 47/0002; E05B 47/0004; E05B 47/0673; E05B 47/0603; E05B 47/06; E05B 2047/0094; E05B 47/023; E05B 47/0012; G07C 2209/04; G07C 9/00666; E05C 1/04; E05C 3/042; E05C 1/004; Y10T 70/7068; Y10T 70/713

USPC ..... 70/77–88, 277, 278.1, 278.2, 278.3, 70/278.7, 279.1, 283, 283.1; 312/215, 312/216, 219

See application file for complete search history.

(56) References Cited

U.S. PATENT DOCUMENTS

| | | | |
|---|---|---|---|
| 2,046,630 | A | 7/1936 | Jacobi |
| 3,455,127 | A | 7/1969 | Simon |

(Continued)

FOREIGN PATENT DOCUMENTS

| | | | |
|---|---|---|---|
| EP | 1178167 | A1 | 2/2002 |

*Primary Examiner* — Lloyd Gall

(74) *Attorney, Agent, or Firm* — Thomas M. Freiburger

(57) ABSTRACT

An electronic cam lock accessible either by PIN code or wirelessly transmitted code from a user's credential has a compact electronics housing that fits neatly and unobtrusively in office furniture, including metal or wood file cabinets. The housing has a rear-extending driver, which may be within a cylinder, preferably positioned where the driver of a cam lock of conventional keyed configuration would be located. One form of the lock is front-recess mounted. In another form the housing is inside-mounted, fitted within the usually one-inch top rail or vertical side rail of a file cabinet, with the electronic access terminal and a rotatable knob exposed for the user. The locks can be connected in a wired or wireless network for controlling access by time or by personnel, or for auditing entries.

12 Claims, 15 Drawing Sheets

(51) Int. Cl.

| | |
|---|---|
| ***E05C 3/04*** | (2006.01) |
| ***E05C 1/04*** | (2006.01) |
| *E05B 65/02* | (2006.01) |
| *E05B 47/00* | (2006.01) |

(56) References Cited

U.S. PATENT DOCUMENTS

| | | | | |
|---|---|---|---|---|
| 3,753,164 | A | 8/1973 | DeVries | |
| 3,754,164 | A | 8/1973 | Zorzy | |
| 3,754,213 | A | 8/1973 | Morroni et al. | |
| 3,831,065 | A | 8/1974 | Martin et al. | |
| 3,878,511 | A | 4/1975 | Wagner | |
| 4,243,256 | A | 1/1981 | Frydrych | |
| 4,495,540 | A | 1/1985 | Remington et al. | |
| 4,568,998 | A | 2/1986 | Kristy | |
| 4,665,397 | A | 5/1987 | Pinnow | |
| 4,748,833 | A | 6/1988 | Nagasawa | |
| 4,887,445 | A | 12/1989 | Beatty | |
| 4,901,545 | A | 2/1990 | Bacon et al. | |
| 4,931,789 | A | 6/1990 | Pinnow | |
| 4,956,984 | A | 9/1990 | Chi-Cheng | |
| 4,967,305 | A | 10/1990 | Murer et al. | |
| 5,020,345 | A | 6/1991 | Gartner et al. | |
| 5,021,776 | A | 6/1991 | Anderson et al. | |
| 5,033,282 | A | 7/1991 | Gartner et al. | |
| 5,136,870 | A * | 8/1992 | Gartner et al. | 70/277 |
| 5,153,561 | A | 10/1992 | Johnson | |
| 5,223,829 | A | 6/1993 | Watabe | |
| 5,225,825 | A * | 7/1993 | Warren | 340/5.22 |
| 5,321,963 | A | 6/1994 | Goldman | |
| 5,373,718 | A | 12/1994 | Schwerdt et al. | |
| 5,385,039 | A * | 1/1995 | Feldpausch et al. | 70/78 |
| 5,461,218 | A | 10/1995 | Castleman et al. | |
| 5,564,294 | A | 10/1996 | Chen | |
| 5,845,523 | A | 12/1998 | Butterweck et al. | |
| 5,886,644 | A | 3/1999 | Keskin et al. | |
| 5,894,277 | A | 4/1999 | Keskin et al. | |
| 6,089,058 | A | 7/2000 | Elpern et al. | |
| 6,116,066 | A | 9/2000 | Gartner et al. | |
| 6,209,367 | B1 | 4/2001 | Hyatt, Jr. et al. | |
| 6,331,812 | B1 | 12/2001 | Dawalibi | |
| 6,347,486 | B1 | 2/2002 | Badillet | |
| 6,384,711 | B1 | 5/2002 | Cregger et al. | |
| 6,655,180 | B2 | 12/2003 | Gokcebay et al. | |
| 6,708,538 | B1 | 3/2004 | Walby | |
| 6,791,450 | B2 | 9/2004 | Gokcebay et al. | |
| 6,989,732 | B2 | 1/2006 | Fisher | |
| D520,340 | S | 5/2006 | Freck | |
| 7,336,150 | B2 | 2/2008 | Gokcebay | |
| 7,516,633 | B1 | 4/2009 | Chang | |
| 7,999,656 | B2 | 8/2011 | Fisher | |
| 8,490,443 | B2 * | 7/2013 | Gokcebay | 70/78 |
| 8,495,898 | B2 | 7/2013 | Gokcebay | |
| 2002/0125992 | A1 * | 9/2002 | Harwood | 340/5.51 |
| 2004/0035160 | A1 * | 2/2004 | Meekma et al. | 70/278.3 |
| 2005/0050928 | A1 * | 3/2005 | Frolov et al. | 70/278.3 |
| 2005/0179517 | A1 * | 8/2005 | Harms et al. | 340/5.9 |
| 2006/0076385 | A1 | 4/2006 | Etter et al. | |
| 2006/0150694 | A1 * | 7/2006 | Frolov et al. | 70/277 |
| 2007/0056339 | A1 | 3/2007 | Irgens et al. | |
| 2007/0169525 | A1 | 7/2007 | Chang | |
| 2007/0209413 | A1 * | 9/2007 | Dobbs | 70/279.1 |
| 2009/0115196 | A1 | 5/2009 | Stango | |
| 2009/0308115 | A1 * | 12/2009 | Gokcebay | 70/277 |
| 2013/0298616 | A1 * | 11/2013 | Ullrich et al. | 70/278.1 |
| 2013/0298619 | A1 * | 11/2013 | Ullrich et al. | 70/283.1 |

* cited by examiner

ELECTRONIC LOCKS PARTICULARLY FOR OFFICE FURNITURE

This application is a continuation-in-part of application Ser. No. 11/809,172, filed May 30, 2007, U.S. Pub. No. 2007/0277571, to be issued Jul. 30, 2013 as U.S. Pat. No. 8,495,898, and of application Ser. No. 12/214,357, filed Jun. 17, 2008, U.S. Pub. No. 2009/0249846, to be issued Jul. 23, 2013 as U.S. Pat. No. 8,490,443. The disclosures of those two copending applications are both incorporated herein by reference in their entireties, including specifications and drawings.

BACKGROUND OF THE INVENTION

This invention concerns locks for cabinets, lockers, drawers, access panels and similar situations. Specifically the invention embraces an electronic cam lock that fits office furniture, usually metal and wood file cabinets and other furniture units with doors, panels or drawers.

Metal and wood file cabinets, desk and cabinet drawers, locker doors, access panels and doors, mail boxes, dispensers and other secure situations often utilize relatively simple lock mechanisms known as cam locks. Such cam locks may or may not involve a camming action. In some cases they move other mechanisms that are engaged with the door or drawer of the cabinet or engaged with other mechanisms that are linked to the door and drawer of the cabinet or multiple doors or drawers of the cabinet. In all cases except plungers, cam locks have a rotatable component at a back side. In one of the simplest forms, a cam lock on a cabinet door typically fits in a ¾ inch diameter D-shaped or double D-shaped hole and, at the back side of the cam lock cylinder unit, has a metal blade or arm called a cam that rotates when the key is turned, from a position disengaged from surrounding cabinet hardware to a position of engagement in a slot or behind a ledge of the surrounding cabinet hardware. Other locks, such as those for desk drawers, commonly referred as cabinet locks, involve a camming type action as the key and plug are rotated, and these are also referred to as cam locks herein. The rotation causes a cam or nipple to move a deadbolt linearly to a locking or unlocking position, or in the case of a spring loaded latch or deadlatch, the rotation causes the cam or nipple to move a latch or deadlatch to unlocking position and removing the key keeps the latch or deadlatch in the extended locked position. The term cam lock excludes door entry locks on commercial or residential buildings. Such locks are heavier-duty and more secure than cam locks, which are typically small (¾ inch hole receives them) and lighter-duty, as for office furniture.

Metal filing cabinets often utilize cam locks, but sometimes have a variation known as a plunger type lock in which a spring loaded plunger/lock cylinder located in the top horizontal margin of the cabinet, when pushed in, will lock all drawers. The use of a key releases the spring plunger to return to the outward position and unlock the drawers. These plunger locks are also referred to as cam locks herein, even though they have no rotatable member that locks and releases doors or drawers.

Locker and cabinet locks have included electronic locking devices, some of which utilized keypads and some of which utilized IButtons or other ID or non-volatile memory devices which work on contact to release the lock. See, for example, U.S. Pat. Nos. 5,894,277, 5,886,644, 6,655,180 and 6,791,450. The disclosures of all of these patents are incorporated herein by reference.

There is a need for a relatively simple, easily used, reliable and compact electronic lock, which may have a keypad but optionally operable by an electronic key or wireless device which may not require contact, or both, for situations in which typically cam, plunger and cabinet locks were employed, and capable of fitting into a small space in the cabinet to produce a low-profile and aesthetic appearance. This is an objective of the current invention described below.

SUMMARY OF THE INVENTION

The invention addresses these needs with a low profile and very compact electronic lock that, in one application, fits in the top one inch horizontal margin or "rail" of a steel file cabinet. The compact electronic locking device in one embodiment has a knob or handle that can rotate the cam lock cylinder plug or other rear-extending driver when such manual rotation is permitted by the lock electronics. A keypad for entry of a code may be included, and if so, the code can be either permanently set to a reprogrammable code, or set in each case by a temporary user, who can then input the same code to lock and unlock the lock, this feature depending on circumstances and function desired.

In one preferred embodiment particularly adapted for a file cabinet, the locking device in one embodiment is less than one inch in height (about ⅞ to 31/32 inch), about five inches in length and roughly about ¾ inch in depth or thickness (or about ½ to ¾ inch), as to the housing of the device. A cam locking device of this size will fit inside the horizontal top rail or vertical side rail, typically a space U-shaped in cross section, with the unit's keypad or access panel and the rotary knob extending through openings formed in the top rail for this purpose. In another embodiment, an electronic lock of a similar size is configured for front-recess mounting. A collar or rim around the face of the housing engages against the face of the file cabinet and the approximately ¾ inch depth of the housing extends into the cabinet.

The housing may contain several battery cells, such as two or three AA batteries. From the back of the housing in one embodiment extends a cam lock cylinder unit which may be of conventional cam lock size, and with a length to fit the application, i.e. the depth of material and configuration where mounted. In other embodiments a dummy plug can extend back from the housing unit, or simply a driver or spindle.

In the inside mount configuration described above, with the lock housing fitting into the top rail of a metal file cabinet and inserted from the inside, the housing can have mounting flanges, one at each end, extending essentially co-planarly with the bottom side of the unit. These mounting flanges allow for screwing or riveting the housing into the top rail from the bottom of the top rail. (References to "top", "bottom", etc. are for convenience in describing the locks as horizontally mounted, as in the top rail. These inside-mount locks can be vertically mounted in the vertical side rail as well; the directional wording is not meant to be limiting.) For the front-recess mount form of the invention, the housing body is retained closely within a preferably rectangular hole in the file cabinet, with the rim that extends from the face bearing against the face of the file cabinet. This configuration includes a plastic or metal receiver casing that is slipped over the body of the lock housing from the back, i.e. from the inside of the panel or drawer or door and which is then secured to the housing body by machine screws to firmly retain the lock and the casing in place. This casing may have a battery case at one end, or a battery case can be separately retained within the file cabinet and connected by wire or plug-in cable to the lock housing. The type of battery housing can be determined by space requirements.

The same front/recess mounted electronic lock can be used for wood file cabinets or other office furniture having a thicker depth, e.g. ¾ inch panels (as opposed to the thin panel of a steel cabinet). In this case the electronic lock includes different components at the back side of the door, drawer or panel. The battery case is positioned essentially flush against the back surface of the drawer or panel and can be directly behind the recess-mounted electronics housing.

In all forms of the electronic lock of the invention, a keypad can be provided and/or a wireless terminal can be provided, which can be RFID, or NFC (near field communication) allowing cell phone access or other wireless communication, all for security in accessing the lock and/or transferring data to or from the lock.

Importantly, the electronic lock device is compact and simple, at least as to mechanical elements, and without any further electronics required to be connected to the lock at the back side of the door or panel. Essentially the only element extending from the lock unit at the back side of the panel is the rear-extending cam or cabinet lock cylinder unit or actuator, i.e. a latch or cam positioned to engage with a ledge or slot or multiple-drawer locking rod or other hardware to retain the door(s), drawer(s) or panel locked.

In a preferred form the invention is embodied in a cam lock for a door, cabinet or drawer mountable from back of the door, cabinet or drawer such that only the user interface and knob extend through the face of the door, etc. and includes a compact electronics housing with an electronic key receptacle and a keypad, RF reader or wireless reader or IButton reader for entry of a code, a driver unit extending from a back side of the housing that matches the end of a cam lock or cam lock plug of the typical mechanical lock for engaging with a strike or other locking bars, cams or apparatus. The knob extends from the housing for operating the cam lock manually when permitted by the electronics. Note that the manual knob in all forms of the invention can be spring-loaded to perform an auto relock feature when applicable to the lock hardware.

In all forms of the invention the electronic lock devices can be fitted with an RJ45 jack or another type of jack or wireless antenna for network connectivity and external power.

It is therefore among the objects of the invention to improve over prior cam and cabinet locks, particularly in office furniture, with an electronic cam lock that can be efficiently installed in doors, drawers, access panels, mail boxes, etc., particularly office furniture. The device is simple, compact, unobtrusive and provides a very clean and integrated appearance. These and other objects, advantages and features of the invention will be apparent from the following description of preferred embodiments, considered along with the accompanying drawings.

DESCRIPTION OF PREFERRED EMBODIMENTS

Figure 1:
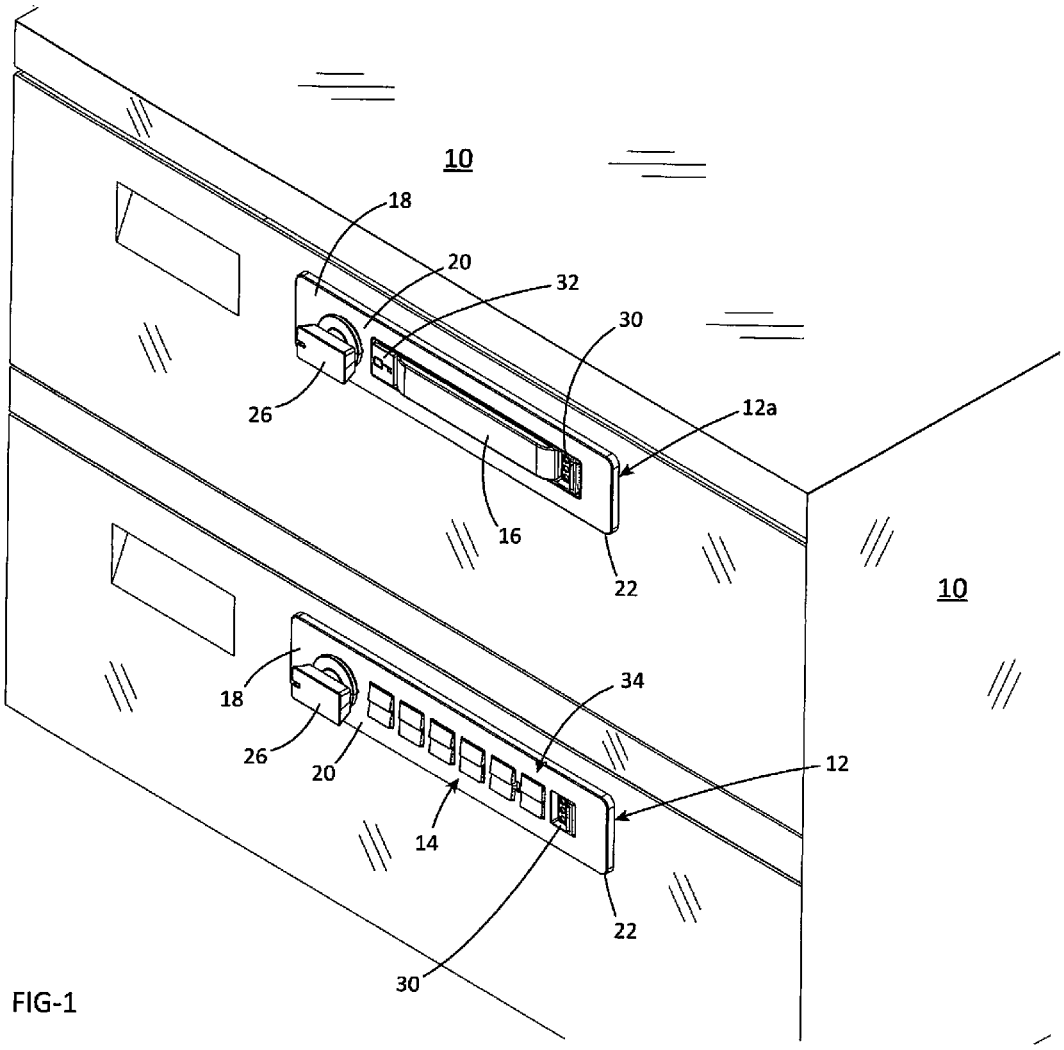
FIG. 1 is a perspective view showing an item of office furniture, e.g. a file cabinet, and showing two different forms of front recess mount electronic cam locks of the invention, showing different access protocols and in both cases with a rotatable knob or handle to release the lock when permitted.

FIG. 1 shows in perspective a file cabinet 10, which in this example is a metal file cabinet with multiple drawers. The drawing illustrates two different types of electronic cam lock according to the invention, installed in this item of office furniture. The lower drawer shows an electronic cam lock 12 having a keypad 14, while the upper drawer has a very similar electronic cam lock **12*a* but without a keypad, and instead with a wireless electronic access device 16. The two locks can in other respects be identical. The electronic access 16** can be an RFID communicating device for use with an RFID credential carried by a user, or it can be any other proximity or wireless, touch-free communication device, including NFC (allowing cell phone access). It could use infrared or encrypted bar code (QR code). Reference herein to entry of a code or access code includes PIN code for keypad locks and also other forms of wireless input, including those mentioned above, i.e. electronically-transmitted codes.

Figure 4:
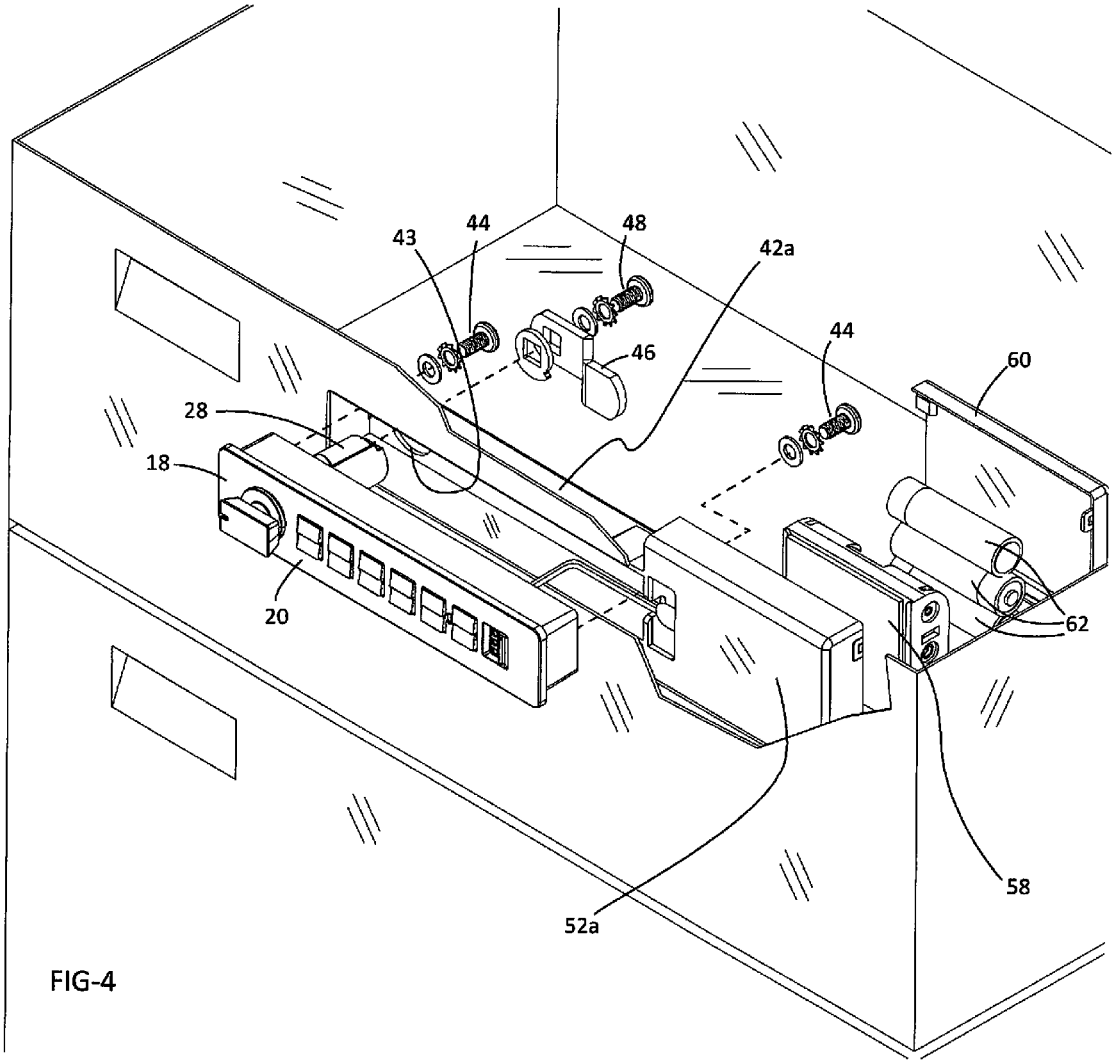
FIG. 4 is a perspective view showing the same electronic lock housing as in FIGS. 2 and 3 as installed in a drawer or panel of office furniture, but in this embodiment with a different form of battery case.
Figure 5:
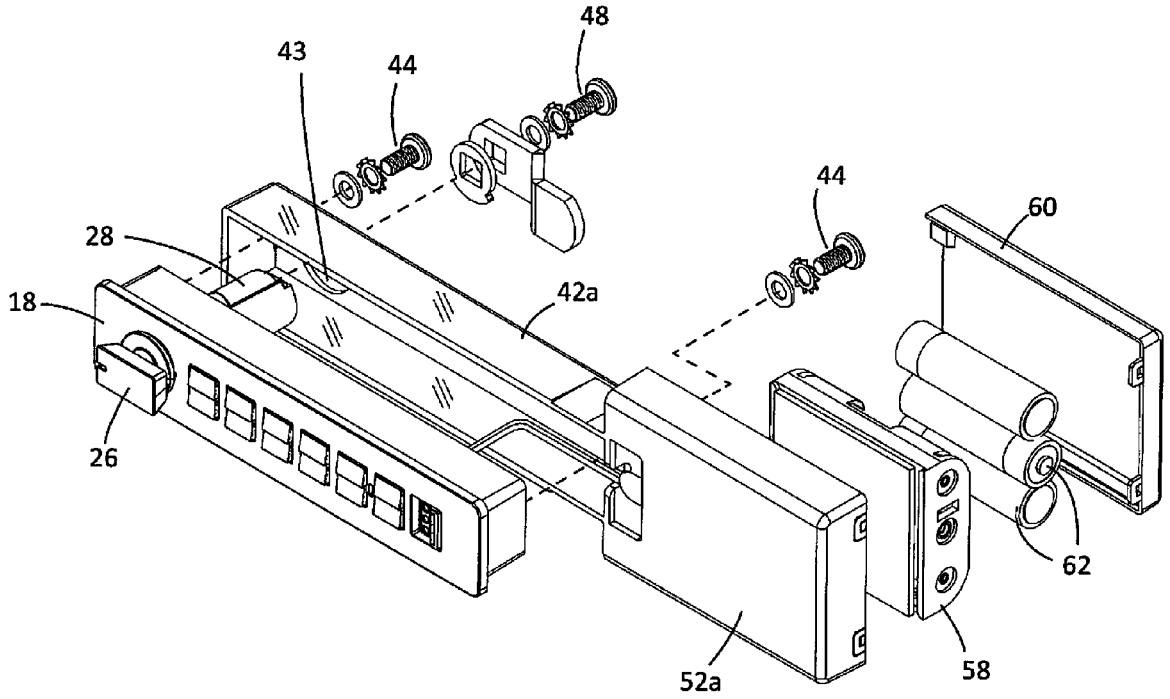
FIG. 5 is an exploded view similar to FIG. 4 but not showing the drawer or cabinet.
Figure 6:
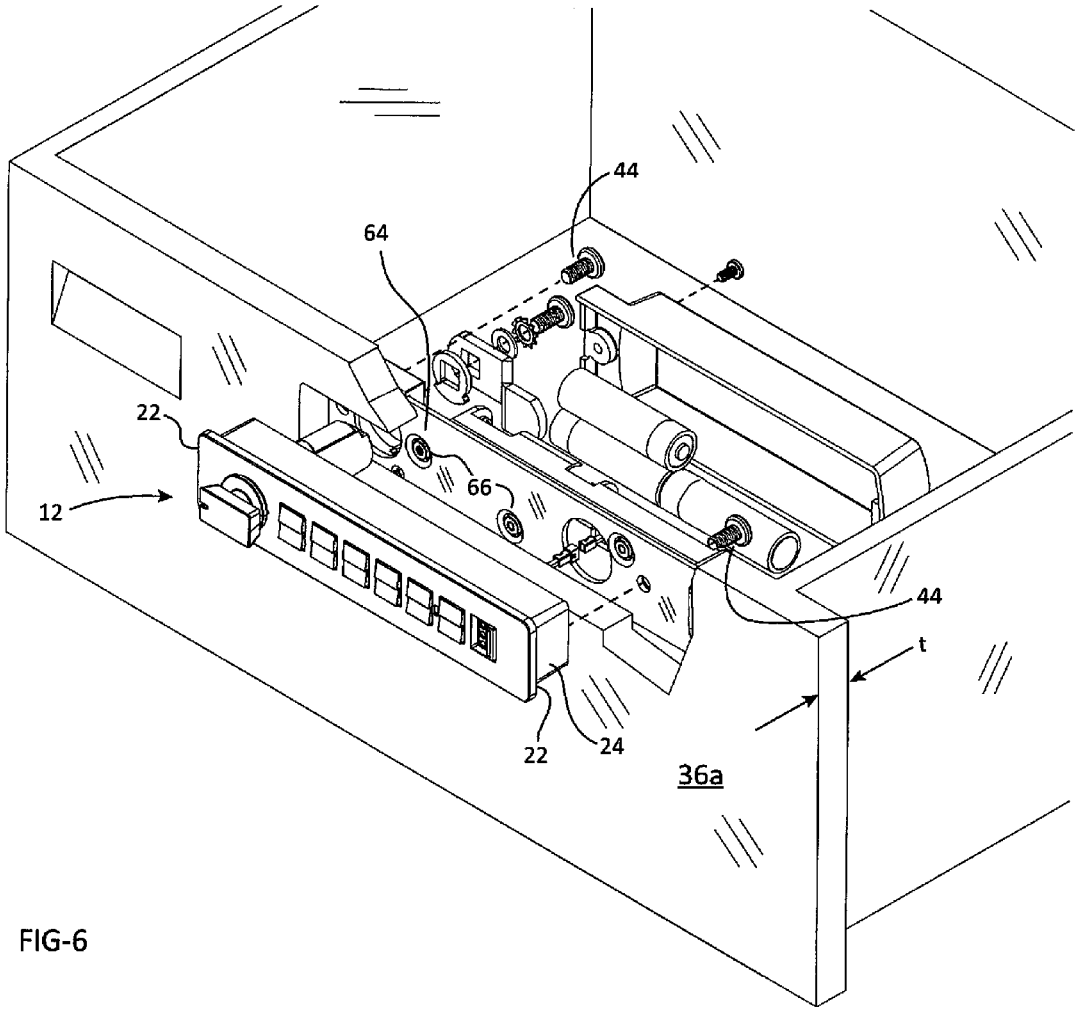
FIG. 6 is a perspective exploded view similar to FIG. 4 but showing a drawer or panel of thicker material, such as wood, approximately ¾ inches thick, the electronic lock housing being the same as in previous figures but with different hardware at the back side of the drawer for retaining batteries.
Figure 7:
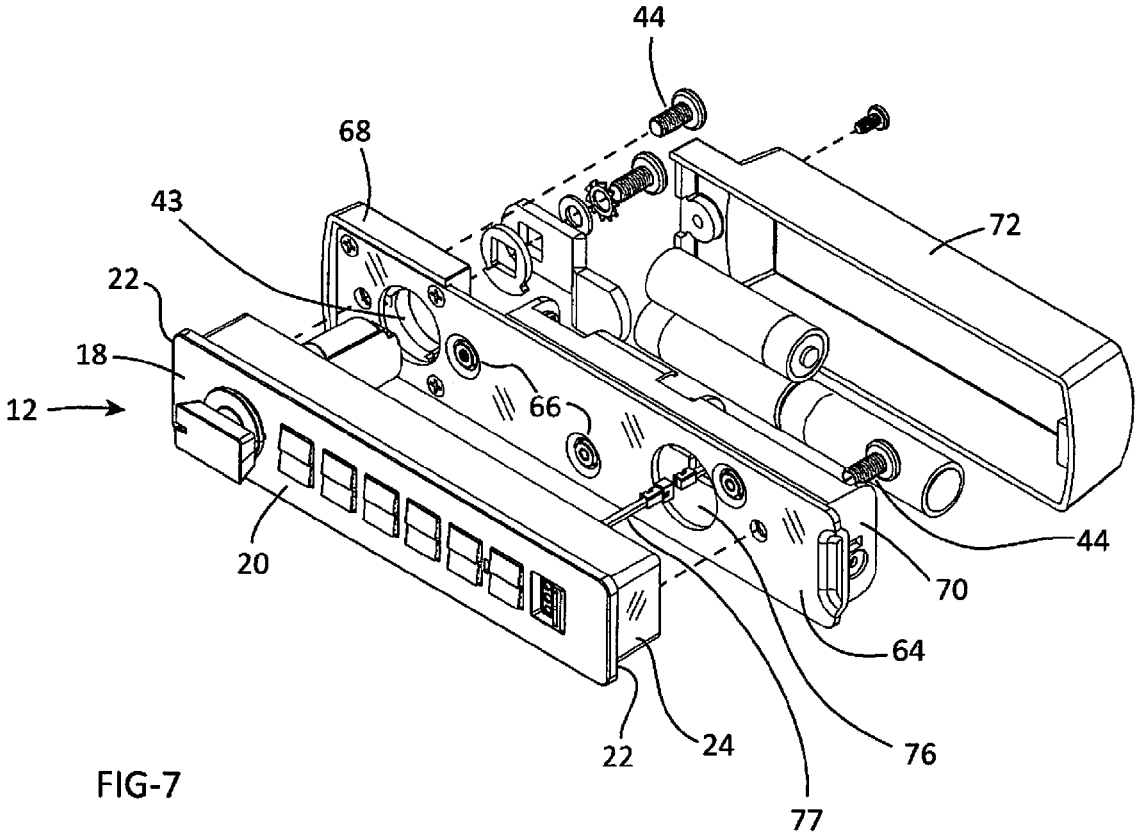
FIG. 7 is an exploded view similar to FIG. 6 but not showing the drawer or panel.

The electronic lock 12 or **12*a* is shown front recess mounted in FIGS. 1-5 and also FIGS. 6 and 7. The lock comprises a housing 18 which has a front face 20 with a rim 22 that extends outwardly (both length and width) slightly more than a body 24 of the housing behind the face plate (see FIG. 2** et seq. for body). For example, the rim can extend about 1/16 inch to ⅛ inch out from the body.

FIG. 1 also shows that the lock includes a manually rotatable knob or lever 26 which can be rotated by a user once access has been authorized, rotating the cam lock plug or driver within the cylinder 28 and an attached cam or latch device directly behind the knob 26 to release the lock and allow opening of the drawer or panel. In addition, a contact terminal 30 is shown on the lock, for accepting a manager's or supervisor's utility or programming "key" device to supply power to the lock when power (e.g. battery) has failed or when an access device or PIN code has been lost, or both. This can operate in the same way as described in U.S. Pat. No. 7,336,150, and the disclosure of that patent is incorporated herein by reference in its entirety. Note that reference to a cylinder with a driver extending back from the housing is intended to include any rotatable element operated by the knob 26 and connected to a cam or latch device, whether an actual cylinder shell is present or not.

As seen in FIG. 1 on the lock device 12*a*, a push-button 32 can be included to wake up the lock device as a power saving measure, followed up by introduction of the credential. Until the button 32 is pushed, the lock is in sleep mode and after it is pushed it looks for a credential. The button 32 is also used in programming functions; for example, after pushing the button for 5 seconds it puts the lock in the programming mode, allowing the insertion of the utility or programming key to be touched, followed by introduction of the credentials that allow opening of the lock. Similarly, the keypad 14 of the lock device 12 (shown on the lower drawer in FIG. 1) has two additional push-button keys 34 beyond the ten numeral keys (e.g. marked "c" and with a key symbol), for instructions to the electronics. For example, the lock electronics might require one of these buttons to be pushed prior to entering a four-digit PIN, and the other of the two buttons to be pushed when the code has been completed. Additionally the lock can be put into the programming mode by pressing C+key symbol+55+key, for example.

Figure 2:
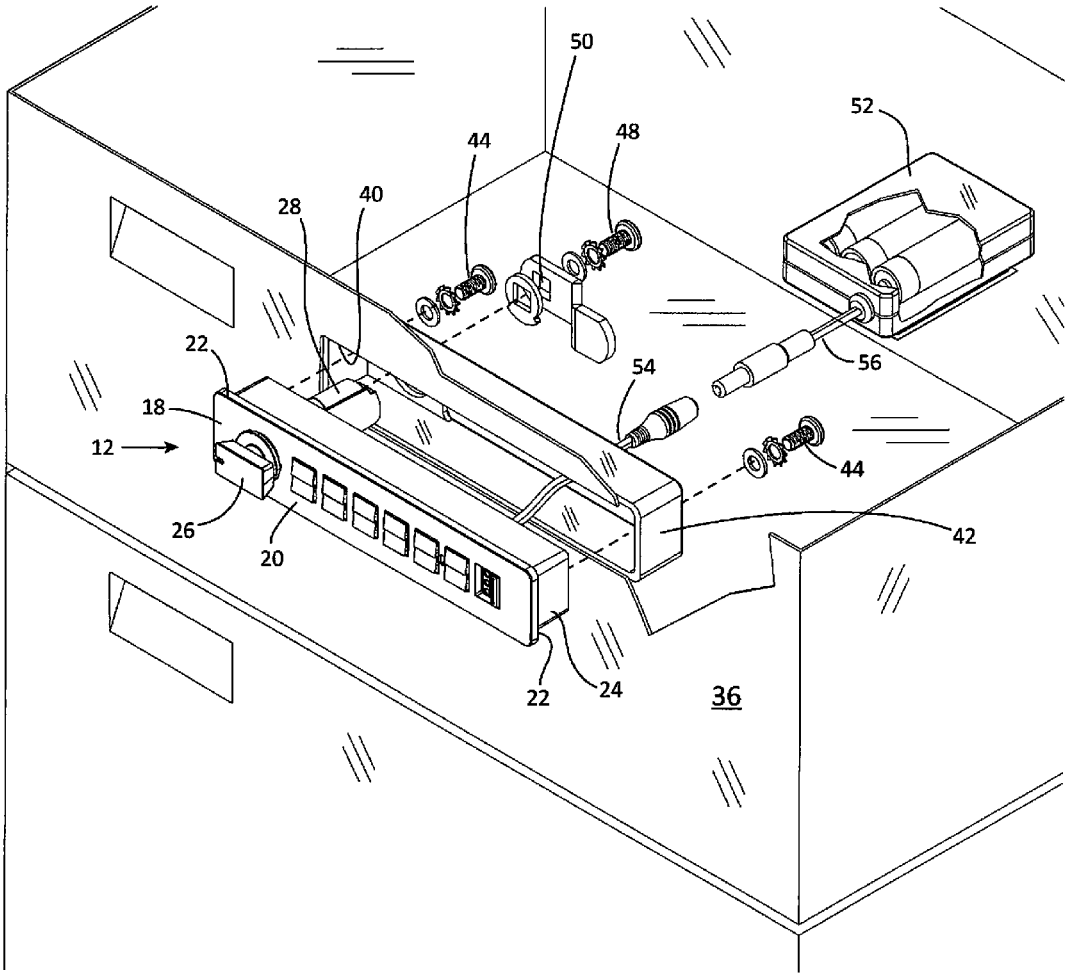
FIG. 2 is a perspective view showing a front recess mount lock as in FIG. 1, the view being exploded to show components as secured to the front and from the rear of the drawer, door or panel, including a battery case connected to the electronics housing.

FIG. 2 shows the lock 12 in a drawer or panel 36 of metal office furniture. This could also be a door or other type of lockable panel. The description of FIGS. 2-5, as well as FIGS. 6 and 7, applies equally to the non-keypad lock 12*a* shown in FIG. 1.

The front recess mount lock 12 is received a rectangular hole 40 formed in the panel 36 at the appropriate location. The panel is assumed to be sheet metal, usually steel, and typically about 12 to 20 gauge. When the lock housing 18 is inserted into the rectangular opening 40, the housing body 24, only slightly smaller than the opening, slips through the opening and the rim 22 around the face plate engages against the surface of the panel 36 surrounding the opening. The cam lock cylinder 28 or other rotatable driver extends back through the opening 40, as does nearly all the depth of the lock housing body 24, which may be about ¾ inch in depth. In this embodiment of the invention, a plastic or metal rear housing or casing 42 is assembled over the back of the housing body 24 from the inside of the drawer or other item of office furniture. The lock cylinder 28 passes through the back of the plastic casing 42 (hole 43), and the casing 42 and lock housing 18 are secured together to firmly hold the lock assembly in place. This can be using machine screws 44 as indicated in the assembly drawings of FIGS. 2 and 3. These views also show a cam 46 of typical configuration being secured onto the rotating element at back of the cam lock cylinder 28, by another machine screw 48, such that the cam 46 rotates with the rotation of the manually-turned knob 26 to lock or unlock the panel. As is typical, a specifically shaped (square) opening 50 in the cam secures it for rotation with the back of the cylinder driver or cylinder plug of the cylinder 28.

Figure 3:
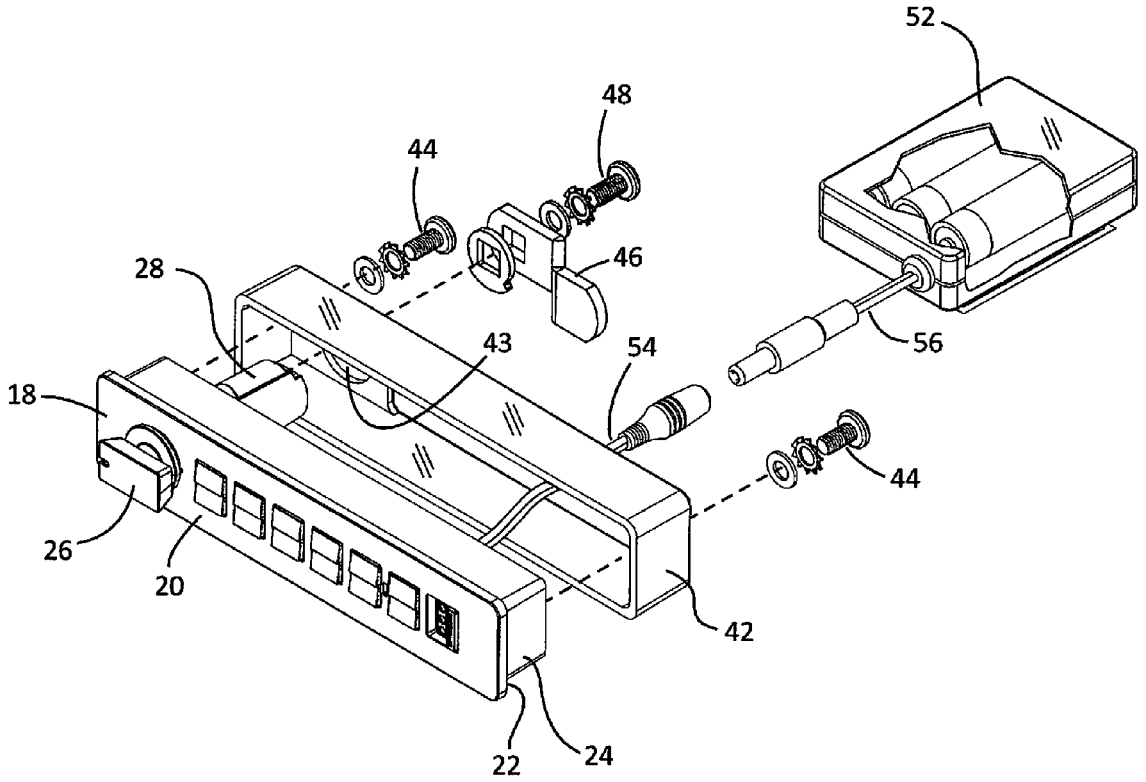
FIG. 3 is an exploded perspective view showing the lock assembly of FIG. 2 and indicating assembly, but with the cabinet not shown.

The exploded views of FIGS. 2 and 3 show that in this embodiment, a battery case 52 is separate from the lock housing and from the rear plastic case 42, connected by cables 54 and 56 and appropriate connectors to supply power to the lock housing. The battery casing or housing 52, which preferably is rectangular, can be secured in any convenient and efficient way to the interior of the cabinet or other office furniture. For example, it could be secured to any inside surface of the drawer shown in FIG. 2, such as by VELCRO hook and loop fastener material, as illustrated below in connection with another embodiment of the invention.

FIGS. 4 and 5 show another preferred embodiment, a variation of the lock assembly shown in FIGS. 2 and 3 in regard to battery location. The exploded views of FIGS. 4 and 5 are the same in many respects as FIGS. 2 and 3, but a plastic lock body-receiving casing 42*a* is integral with the battery case 52*a*. As these drawings indicate, the battery case 52*a* (which may hold three AA battery cells) preferably is integrally formed with the body-receiving casing 42*a*, with a battery-engaging holder 58 secured in the casing 52*a* and a battery cover 60 that snaps together with the battery case 52*a*. AA batteries are shown at 62. Again, the body-receiving case 42*a* has a hole 43 through which the cam lock cylinder or driver 28 extends, and this casing may be secured to the electronic lock housing 18 by machine screws 44 assembled from the rear. The integral device comprising 42*a* and 52*a* of the battery-receiving components and cover may be called a rear cover and power unit of the lock assembly. The rear cover/battery power unit of FIGS. 4 and 5 can be used when space permits at the back of the drawer or panel.

FIGS. 6 and 7 show another variation, again with the identical electronic lock housing 12 (or 12*a*), in a front recess mount, as in the drawings discussed above. In this case the lock housing 12 and lock assembly are fitted into a drawer or panel 36*a* of thicker dimension, such as a wood desk drawer or wood cabinet drawer, having a thickness t of approximately ¾ inch. The broken away, exploded view of FIG. 6 indicates that the body 24 of the front recess mounted lock housing is fitted again into a rectangular hole slightly larger than the body 24, but the rear of the body 24 will be approximately flush with the back side of the panel 36*a* when fully inserted with the housing rim 22 engaged against the panel 36*a* surface. In this case a rear plate 64, preferably of metal, is assembled from the rear to the electronics housing, preferably using machine screws 44 as described above. This tightly sandwiches the panel structure 36*a* between the lock housing rim 22 and the rear plate 64. For this purpose the housing body 24 preferably is slightly less than ¾ inch thick to allow for some variation in thickness of the panel 36*a*. The plate should not "bottom out" against the back of the housing body 24 but should be pulled toward a housing body by the screws 44 to make a tight engagement with the panel structure. The plate is flat since there is no need to receive any portion of the lock body 24, which does not protrude through the back of the thick panel 36*a*. The metal plate 64 has attached to it (by fasteners—pem nuts are shown at 66, fixed to the metal plate to allow a screw to be received) several plastic components as shown at 68 and 70, the latter being a battery contacting holder. A hollow battery cover 72 is shown for securing to the plate 64 or connected structure to close the battery compartment. A power cable is shown at 77, with connectors, for electrically connecting the electronic housing 18 to the power supply, i.e. batteries, the cable extending through a hole in the plate shown at 76. As an alternative, fixed male and female connectors could be positioned on the back of the housing body 24 and on the battery holder 70, exposed through the hole 76, so that connection is made without wires when the plate 64 is secured to the electronics housing when the lock is assembled to a panel. The use of an electric cable gives more versatility since the drawer or panel can vary in thickness.

Figure 8:
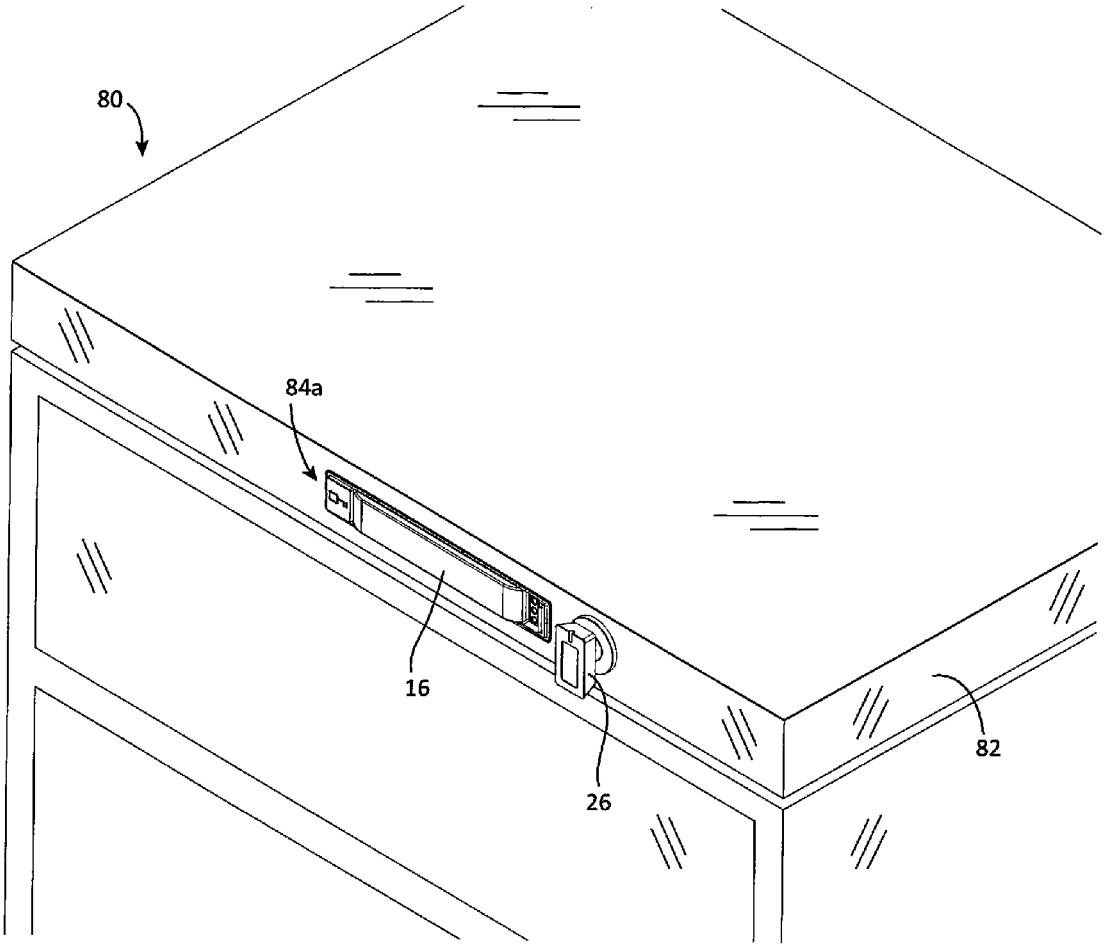
FIG. 8 is a perspective view showing the front of a file cabinet or other item of metal office furniture, with another embodiment of the electronic cam lock of the invention, fitted into the top rail of the cabinet.
Figure 9:
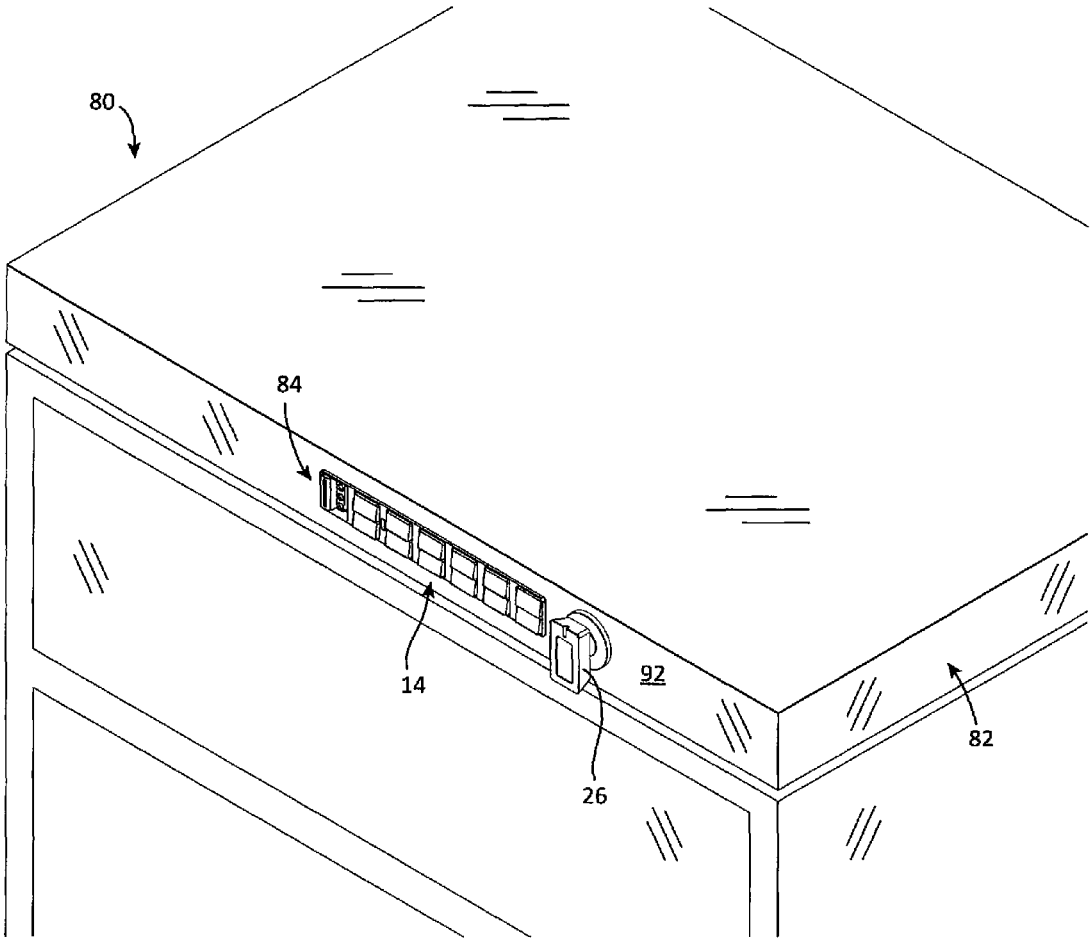
FIG. 9 is a view similar to FIG. 8, but showing a keypad as the primary accessing feature of the electronic lock.

FIGS. 8 through 13 show another form of electronic cam lock and lock installation according to the invention, again in office furniture, specifically a metal cabinet or other metal office furniture 80 having a top rail 82. FIG. 8 shows a wireless non-keypad electronic cam lock 84*a* with access feature such as shown in the lock 12*a* in FIG. 1, but configured differently for inside mount. FIG. 9 shows an electronic cam lock 84 which is identical in all respects to the lock 84*a* but with a keypad 14. The locks 84 and 84*a* have functions similar to those described above. All discussion of the lock 84, as regards installation of securing within the top rail 82 of the cabinet, as well as battery treatment and location, apply to the lock 84*a* as well. Also, all such discussion is intended to apply to a file cabinet vertical side rail as well.

FIGS. 9 through 12 should be viewed together regarding the description of this lock and installation.

Figure 11:
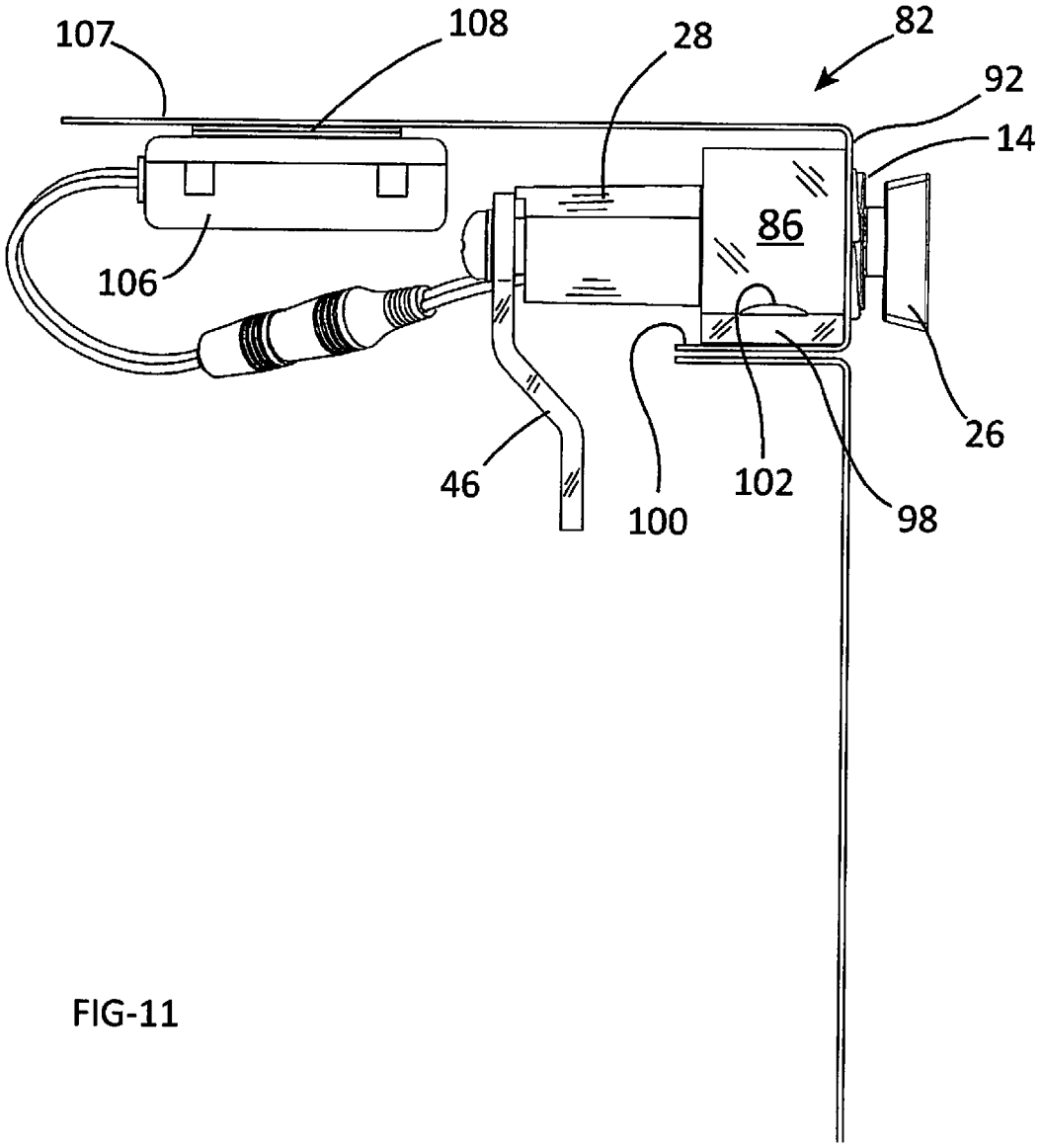
FIG. 11 is a side elevational section view showing the lock installation of FIGS. 8, 9 and 10.
Figure 12:
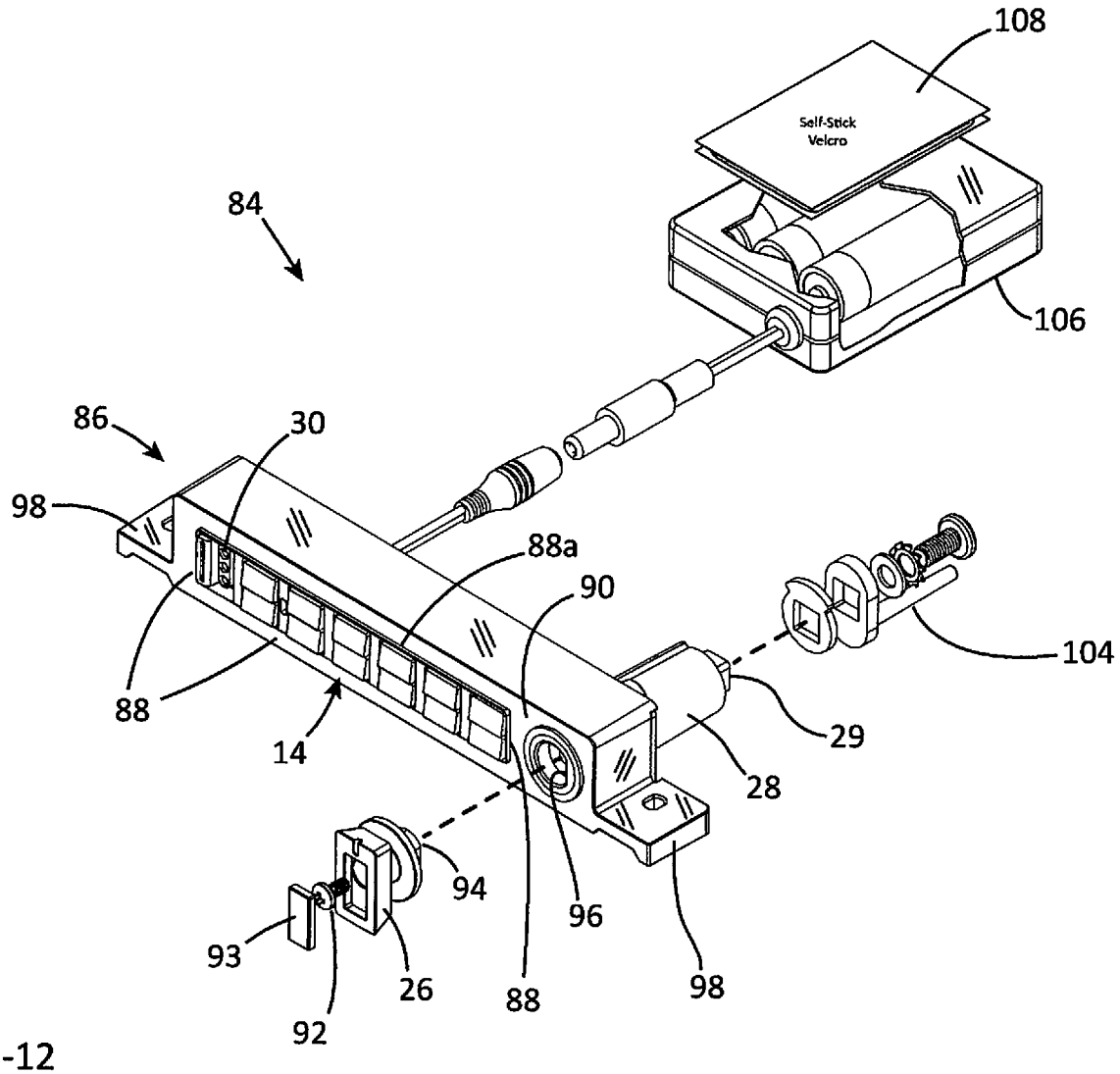
FIG. 12 is a perspective, exploded view showing the lock assembly of FIGS. 8-11 but without the cabinet.

FIG. 12 shows the electronic cam lock assembly 84, without the cabinet. The assembly includes an electronic lock housing 86 with the secure accessing feature 14, the housing being of limited height so as to fit into the top rail of metal office furniture. Typically the top rail of a metal file cabinet is generally U-shaped in cross section (see FIG. 11) and has an inside clearance of about 1 inch. The lock housing 86 preferably has a height of about 15/16 inch or about 31/32 inch, so as to fit within this top rail space. The access feature 14 defines a rectangular protrusion 88, i.e. a portion of the housing face 90 protruding slightly (no more than about 1/16 inch) from the face of the housing, that face 90 bearing against the inside surface of the front piece 92 of the top rail. The protrusion 88 is defined by a peripheral rim 88*a*, seen best in FIG. 12. Thus, the accessing feature 14 (here, keypad and emergency access terminal 30) fit closely within a rectangular cutout provided for this purpose in the front top rail piece 92, with the rim 88*a* very closely fitted in the cutout, providing a neat and unobtrusive, built-in appearance as can be seen in FIGS. 8 and 9.

Figure 10:
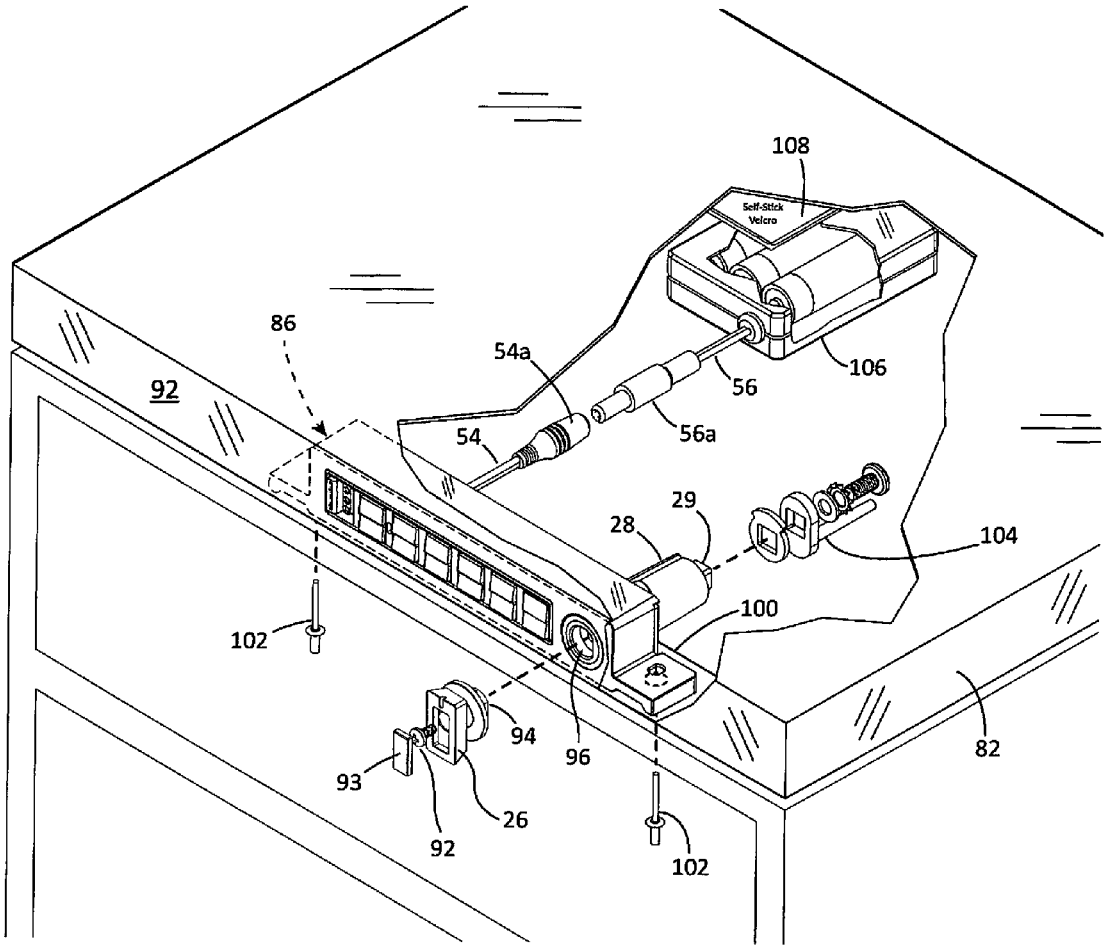
FIG. 10 is a perspective view similar to FIG. 9, but partially broken away and exploded, revealing the position of the electronic lock housing in the top rail of the cabinet and showing cam and battery case features.

In addition to the access terminal, a knob or lever 26 must also be positioned at the outside of the top rail. A second opening, preferably circular, can be provided in the rail for this purpose as indicated in FIG. 9. As indicated in FIGS. 10 and 12, the knob or handle 26 is assembled onto the electronics housing 86 after installation of the housing in the top rail. This can be, as shown in FIGS. 10 and 12, by a machine screw 92 (covered by a snap-in obscuring insert 93), and with the knob having a shank 94 of specific shape, such as a D shape, so as to fit in an oriented position in a similar-shaped socket 96 of the electronic cam lock housing. This rotatable socket 96 then operates the cam lock, turning the rotatable member 29 of the cam lock cylinder when permitted by entry of a proper access code. Note that a single opening could be provided through the front rail piece 92 to accommodate the access feature 14 and the knob together, preferably with a relieved rim surrounding both and fitting closely within the cutout opening.

Although the inside-mount electronic cam housing 86 could be secured to the top rail front piece 82, as by machine screws or rivets, in this preferred embodiment the attachment is all internal and not exposed, via side-protruding horizontal flanges 98 integral with the housing 86 and extending generally planarly along the bottom of the housing. This allows securing to the bottom piece 100 of the top rail 82 of the cabinet, by machine screws or rivets 102 as shown in the exploded and partially cut away view of FIG. 10. The assembled lock is also well illustrated in FIG. 11, a sectional side elevation view showing the lock housing 86 secured to the bottom flange or section 100 of the top rail 82, with the electronic access panel 14 and knob or handle 26 extending outside the top rail. Again, the lock housing 86 could be inside-mounted in a vertical side rail of a file cabinet.

FIG. 10 shows the cam lock assembly 84 fitted with a type of cam 104 that raises and lowers a rod (not shown) for simultaneously locking or unlocking a series of file cabinet drawers, which is an important application for this inside-mount, rail-contained form of cam lock. This is the same hardware used with conventional cam locks that simply rotate with a key, and the electronic lock 84 substitutes for the conventional device, in the same location in the cabinet. In fact all locks herein are located with lock cylinder at the same location as for conventional cam locks, so that the same internal hardware of a manufacturer can be used. FIG. 11 shows the electronic cam lock 84 with a typical offset cam 46 as the locking element, similar to what is shown in FIGS. 2-7.

With this top rail installation, a battery case 106 that generally is not secured at the back of the electronics housing 86. The battery case 106 can conveniently be secured to the electronics housing by cables 54, 56 and connectors 54*a*, 56*a*, and with the casing secured to the underside of the top panel 107 of the file cabinet such as using self-stick VELCRO hook and loop fastener material 108. This is shown in FIGS. 10, 11 and 12. Other positions for the battery case are also possible, but retaining it within the height of the top rail 82 assures there will be no interference with action of the top drawer.

Figure 13:
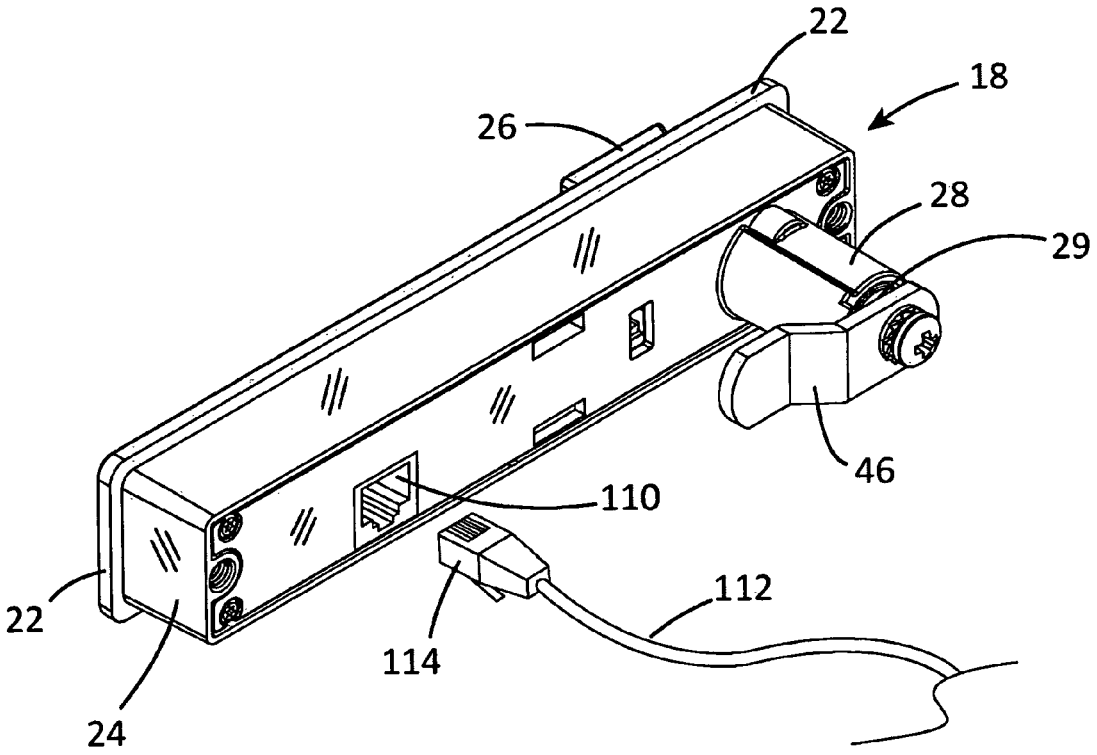
FIG. 13 is a rear perspective view showing the invention with a power over Ethernet connector for data and power connection.

FIG. 13 shows the electronic cam lock housing unit 18 from the back side, as in FIGS. 1-7, showing the rearwardly protruding housing body 24, the laterally protruding mounting rim 22 and the cam lock cylinder 28 and rotating driver 29, and also revealing the optional inclusion of an RJ 45 receptacle, at 110. A cable 112 with an RJ 45 connector 114 is shown in position to be plugged into the receptacle. As mentioned above, the cable 112 can power the lock with line power in lieu of batteries, and also hook up to a data network simultaneously. Such a data network is useful in a network of office furniture, such as file cabinets, to provide a record of entries to the cabinets and also, when desired, to control who may gain access to which file cabinets at specific dates and times. With a network, this access control can be set up and monitored from a secure central location.

If the electronic cam locks of the invention are wired for networking, this could be either individually or in groups. The wiring can be done as part of a bus system where the locks can be wired for data, with the same cable also providing power. This can allow the units to be wired and receive data such as access data. Even without wiring, a data network can be established using a WiFi for a group of locks, and access and/or audit data can be transmitted to and from the locks from a central location, via the WiFi or Internet connection. The information can be distributed to all locks in the system either individually or as a whole, but with data coded for particular locks as needed.

This is a power over Ethernet arrangement when both power and data are carried by the cable 112. Note that connectors other than RJ 45 could be used.

Figure 14:
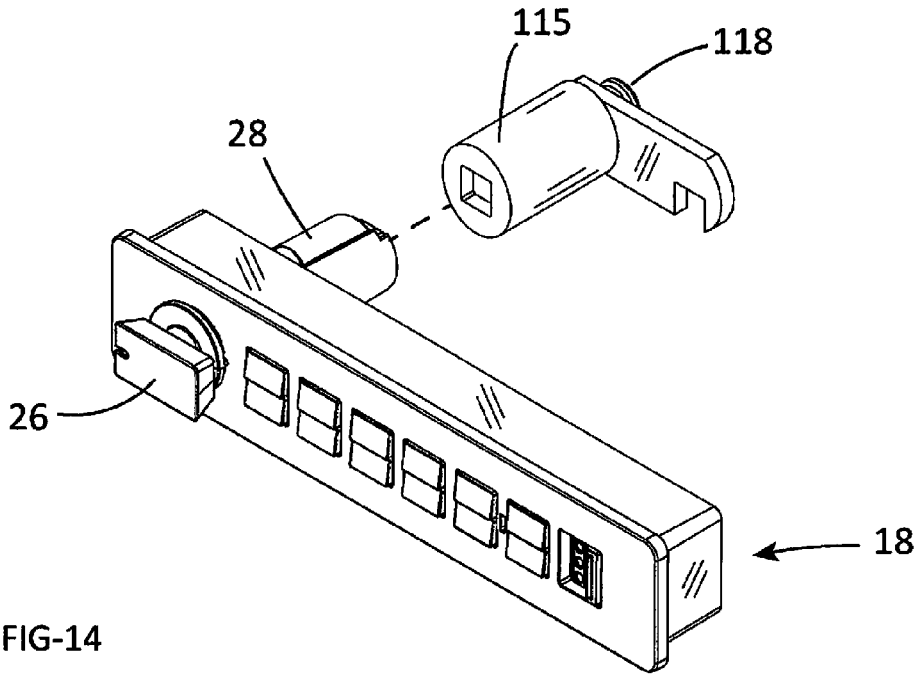
FIGS. 14 and 15 show different extensions for a driver.
Figure 15:
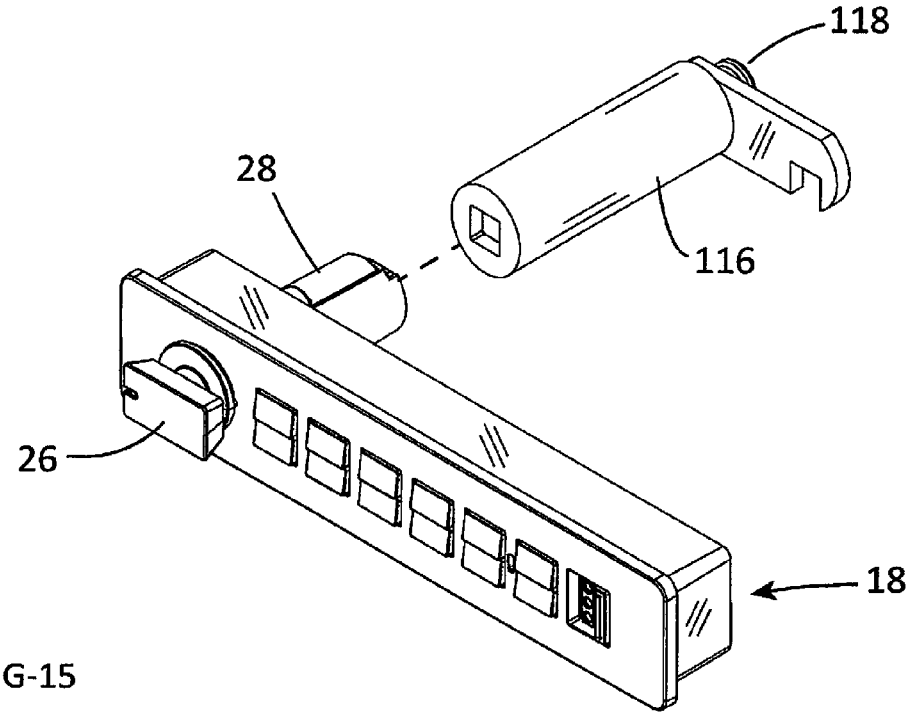

FIGS. 14 and 15 demonstrate that an electronic cam lock according to the invention, including any of the embodiments, can be fitted with any desired length of extension of the rotatable cylinder shaft or driver. These drawings show extensions 115 and 116 of different lengths. The initial shaft from the cylinder 28 is relatively short, but the shaft or driver can be extended to any desired length to achieve the correct length required for the application. The extension is secured to the shaft or driver via a machine screw 118 of appropriate length.

Figure 16:
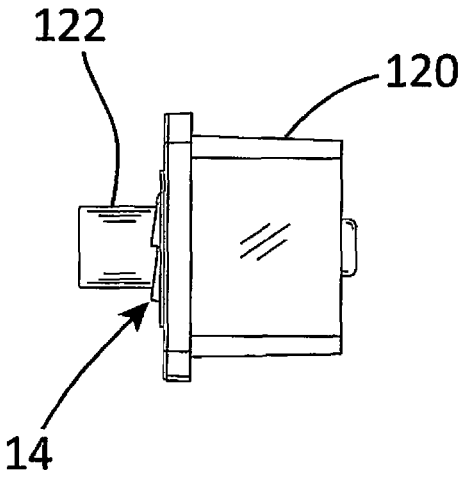
FIGS. 16 and 17 show the invention as a plunger lock.
Figure 17:
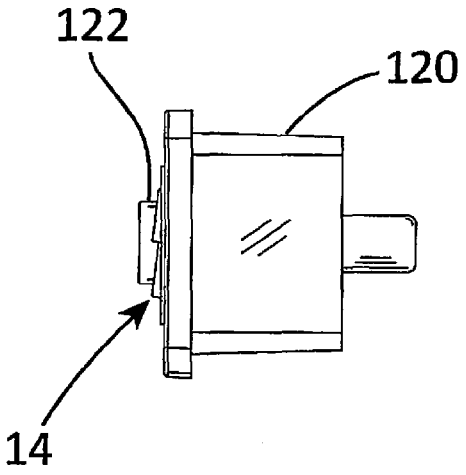

FIGS. 16 and 17 show a plunger lock 120 constructed according to the invention, with a keypad 14 or a wireless access 16 such as shown in other embodiments. The lock 120 is shown as having a front-recess mounting housing, as in FIGS. 1-7, but it could be an inside-mount as well, as shown in FIG. 8 et seq. With this type of lock 120, the plunger 122 is spring-biased outwardly to the position shown in FIG. 16, which is the unlocking position. For the locked position shown in FIG. 17, the user pushes inward on the plunger with sufficient force to overcome the strain and mechanical resistance, and at that point the plunger latches inwardly at the position shown in FIG. 17. The mechanism behind the lock is the same as in conventional plunger lock operation, and is not shown here, but the movement of the plunger actuates an internal mechanism, as in a file cabinet, to effect locking of all drawers. With the invention, the proper entry of a PIN code or a wirelessly-transmitted electronic code will cause the movement of a small blocking pin or other restraint device inside the lock when in the position shown in FIG. 17, to release the restraint and allow the internal spring to pop the plunger back out, granting access.

As noted above, the entire disclosures of copending application Ser. Nos. 11/809,172 and 12/214,357, as well as U.S. Pat. No. 7,336,150, are incorporated herein by reference. All disclosure regarding networking, antennas, different types of wireless access reader protocol, emergency access or power loss, etc. can be applied to the locks disclosed herein.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. An electronic cam lock on a door, cabinet, panel or drawer in a cabinet or furniture that provides ingress and no egress, without a mechanical key, comprising:

a compact housing containing electronics and having an access terminal enabling entry of a code by a user, such code when properly entered causing the electronics to permit access, the housing being affixed to a panel of said door or drawer or other structure of said cabinet or furniture, and the housing having a housing body and a face fixed at the front of the housing body, the face having a peripheral rim that extends outward laterally beyond the housing body, and the housing being mounted in an opening in the panel which is sized to closely receive the body of the housing and not the rim, such that the rim of the housing is positioned against the front of the panel with the face exposed at the front of the panel, a cam lock cylinder unit extending from a back side of the housing, with a lock driver in the cylinder unit engaged with a cam or latch device at the inside of the panel of the cabinet or furniture, and including a knob or handle on the housing for operating the lock manually without a mechanical key to rotate the lock driver and the cam or latch device when permitted by the electronics, and a power source connected to power the electronics.

2. The electronic cam lock of claim 1, wherein the housing and the opening to the panel are generally rectangular in shape.

3. The electronic cam lock of claim 1, wherein the panel is of sheet metal, about 12 to 20 gauge, such that the housing body protrudes inwardly into the cabinet or furniture, and including a rear casing at the inside of the panel, covering the housing body from the back, and wherein the housing and rear casing are secured to the panel by fasteners extending through the rear casing and engaged with the housing body.

4. The electronic cam lock of claim 3, wherein the rear casing has a back panel with an opening through which the cam lock cylinder unit extends.

5. The electronic cam lock of claim 3, wherein the power source comprises a battery pack, the battery pack being secured on the inside of the cabinet or furniture and connected by electrical cable through the rear casing and to the housing.

6. The electronic cam lock of claim 3, wherein the rear casing is a part of a combined rear casing and battery power unit, including a battery casing serving as said power source and integrally formed laterally at one end of the rear casing, containing batteries and being connected electrically to the housing.

7. The electronic cam lock of claim 1, wherein the panel of the cabinet or furniture has a thickness of about ⅝ inch to ¾ inch, and wherein the housing body extends into the opening of the panel such that a back side of the housing body is approximately flush with an inside surface of the panel, and wherein a plate is included inside the cabinet or furniture, immediately behind the housing, and the plate and housing being retained on the panel by fasteners extending through the plate and engaged with the housing so that both the plate and the rim of the housing bear against the panel.

8. The electronic cam lock of claim 7, wherein the plate has an opening through which the cam lock cylinder unit extends.

9. The electronic cam lock of claim 8, wherein the power source comprises a battery casing secured to the back side of the plate, containing batteries, and the batteries being connected to power the electronics of the housing.

10. The electronic cam lock of claim 1, wherein the power source is a cable feeding line power to the housing.

11. A network of electronic cam locks on cabinets or furniture, each electronic cam lock being in accordance with claim 1, with a data port on the housing of each cam lock connected by a cable to the network.

12. The electronic cam lock of claim 1, wherein the access terminal includes an RFID reader for an RFID tag that can be carried by a user.

* * * * *